United States Patent [19]

Gelernter et al.

[11] Patent Number: 4,811,023

[45] Date of Patent: Mar. 7, 1989

[54] ANTENNA PERFORMANCE EVALUATION METHOD AND APPARATUS

[75] Inventors: Boaz Gelernter, Long Branch, N.J.; Dick M. Joe, Anaheim, Calif.

[73] Assignee: The United States of America as represented by the Secretary of the Army, Washington, D.C.

[21] Appl. No.: 185,735

[22] Filed: Apr. 25, 1988

[51] Int. Cl.[4] ..... H01Q 3/30

[52] U.S. Cl. ..... 343/703; 342/372

[58] Field of Search ..... 343/703; 342/354, 359, 342/368, 372, 377, 383, 384, 435, 442

[56] References Cited

U.S. PATENT DOCUMENTS

| | | | |
|---|---|---|---|
| 4,359,740 | 11/1982 | Frazita | 343/703 |
| 4,532,518 | 7/1985 | Gaglione et al. | 343/703 |
| 4,697,141 | 9/1987 | Feldman | 343/703 |

*Primary Examiner*—William L. Sikes
*Assistant Examiner*—Doris J. Johnson
*Attorney, Agent, or Firm*—Sheldon Kanars; Maurice W. Ryan

[57] ABSTRACT

Phased array antennas are rapidly tested for performance degradation utilizing a beam steering computer unit and built-in test equipment. The antenna includes a plurality of bays in a planar matrix, each bay having subarray modules containing pairs of dipoles. The beam steering unit controls scanning of driver cards having drivers which apply bias voltages to phase shifter diodes or bits of various fixed angular sizes in a main array and subarray. The bits are sequentially tested for current faults, with information obtained on number, size, and location of failed bits determining performance degradation of a predetermined threshold. Larger phase bits of the main array are given more weight than smaller subarray bits. The effect of the failures on sum beam gain and azimuth and elevation differences pattern null depths are computed and compared with the threshold to indicate whether performance is acceptable.

7 Claims, No Drawings

ANTENNA PERFORMANCE EVALUATION METHOD AND APPARATUS

The invention described herein may be manufactured, used, and licensed by or for the Government for governmental purposes without the payment to us of any royalty thereon or therefor.

BACKGROUND OF THE INVENTION

1. Field of the Invention

The present invention relates to antenna test and measurement systems and particularly to a method and apparatus for establishing a threshold for acceptable phased array antenna performance which is dependent upon the number, size and location of failed components.

2. Description of the Prior Art

Present apparatus for testing phased array antennas include a beam steering computer unit and built-in test equipment. A typical phased array antenna includes a plurality of bays with subarrays including dipoles arranged in linear horizontal and vertical matrices incorporated in a planar dielectric radome, such as shown and described in U.S. Pat. No. 4,468,669. The beam steering unit controls a plurality of drivers which apply bias to phase shifter scanning elements connected to the dipole array to test and analyze various output parameters and faults. These include phase shifter bit-to-bit failure and various performance characteristics which are tested without causing degradation of antenna performance. Thresholds have been established to determine minimum standards of performance and maximum fault counts at which the antennas are rejected as unacceptable. The total fault count of the formerly used procedure, however, was arrived at without regard to location of the failed bits, made no distinction between large and small main array bits, and employed an incorrect heavier weighting of subarray bits as compared to main array bits. This resulted in a fault count which did not provide a sufficiently accurate basis for antenna performance projections.

SUMMARY OF THE INVENTION

It is therefore the primary object of the present invention to provide an improved system for rapid testing of antennaas and estimating degradation of phased array antenna performance characteristics.

A further object is to employ information on the location, number and size of failed phase shifter bits to provide a more accurate measure of the degradation of antenna gain and azimuth and elevation difference pattern null depths.

It is also an object of the invention to estimate gain degradation, and azimuth and elevation null shift at one scan angle.

Another object is to establish a more precise threshold for evaluation of antenna performance characteristics below which the antenna is unacceptable.

These objects are achieved by taking measurements of antenna performance characteristics employing a beam steering unit and built-in-test equipment of the phased array. Input data on component failures including location and size of each failed phase shifter bit are used to estimate the degree of antenna performance degradation. The effect of the failures on sum beam gain and azimuth and elevation difference pattern null depths are calculated and compared to a preset threshold to indicate whether performance is acceptable. A fault identification test measures failures of the main array drivers or phase shifters of various fixed phase bit sizes and the location of each failed main array steering bit, in addition to subarray drivers or phase shifters, including the subarray bit size, location and number of radiating modules affected by the particular subarray bit failure. Since the effect of each failure on antenna performance is stongly dependent upon location, to arrive at reasonable gain and null depth estimates the formulas for this procedure are weighted to take the appropriate aperture distribution into account. Relevant weights for the field distribution amplitudes are provided for the sum beam, elevatIon difference beam and azimuth difference beam for a rectangular array lattice to establish the desired criteria. Other objects and advantages will become apparent from the following description in conjunction with the accompanying drawings.

BRIEF DESCRIPTION OF THE DRAWINGS

FIG. 1 is a schematic representation of a front view of the antenna planar array with a plurality of rectangular bays containing subarray modules;

FIG. 2 is a schematic representation of six subarray modules of one bay, each subarray having six pairs of antenna dipoles and a common phase shifter;

FIG. 3 is a further schematic representaion of the arrangement of a main array phase shifter and two subarray phase shifters associated with the six pairs of antenna dipoles;

FIG. 4 is a schematic diagram indicating a driver card and associated subarray modules; and FIGS. 5*a* and 5*b* show representative antenna response curves in an ideal case and with an assumed degradation from current faults resulting in a null shift.

DESCRIPTION OF THE PREFERRED EMBODIMENT

There is generally an extensive lapse of time following full scale R.F. tests of antenna subsystems until final acceptance of a complete radar system. These tests include far field pattern measurements or near field probing. During this time various antenna and beam steering component failures have been found to occur, so that it is necessary to provide a further local screening test prior to acceptance when full scale testing is impractical and facilities are not available. The desired information can be obtained rapidly from input data on component failures, including location and size of each failed phase shifter bit, from the phased array antenna system beam steering computer and built-in test equipment. The effect of failures on sum beam gain and azimuth and elevation difference pattern null depths can be quickly calculated and compared with preset thresholds to determine performance which is above or below a maximum permissible degradation level.

As shown in FIG. 1, a typical planar phased array antenna 10 includes sixty rectangular bays 12 arranged in eight vertical columns A–H and nine horizontal rows 1–9. Each bay includes six subarray modules 14, as shown in FIG. 2, with each module containing six dipoles 16 arranged in three pairs controlled by a phase shifter assembly 18. The phase shifter includes a plurality of diodes which apply various phase shifts to the associated dipoles. As shown in FIG. 3, the dipoles of the main array which provide scan in azimuth and elevation are controlled by a four-bit phase shifter 20 which applies phase shifts from 0° to 360° in steps of 22.5°, using phase bits of 22.5°, 45°, 90° and 180° to all of the dipoles 16 in a predetermined scanning sequence. The subarray provides a smaller elevation scan controlled by two phase shifters 22 which use phase bits of 24.8° and 24.8° and 49.6° to respective pairs of dipoles.

Incorporated into the antenna array is a test target injection and bore site scope element 24 which is substituted for one subarray module of one bay to facilitate the antenna test procedure. Two bits associated with this module which would be considered as failures are ignored for test purposes. Driver cards which contain circuits for applying appropriate bias voltages to the phase shifter diode are located in the beam steering unit card rack 26 below the antenna bays. The beam steering unit and built-in test equipment scan the drivers and dipoles in a desired sequence to obtain the required performance data. A typical driver card 28 and associated subarray modules 14 are shown in FIG. 4. There is one driver card for each of the sixty bays, each card controlling six modules including twenty-four main array bit drivers (180°, 90°, 45° and 22.5°) and four subarray bit (SAB) drivers, two of which drive six subarray bits and two driving three subarray bits. Since failure of the main array bits has greater effect on gain, and azimuth and elevation null depth than failure of subarray bits, the larger phase bits of the main array are given more weight in determining performance degradation than the smaller subarray bits. The present improved system takes into account both size and location of main array bit failures, while subarray bit failures, which can affect only one pair of elements in a six element radiating module, are given less weight.

In order to assess the effect of random faults on antenna performance, this procedure provides means for estimating sum beam gain, and the depth of the principal null of azimuth and elevation difference patterns, all in their unscanned position. Pass/fail thresholds for gain and null depth are also included.

The test provides an evaluation based on beam steering unit driver card current faults or failures. While both current and voltage fault data is available in stored test data, only current faults are used for this antenna performance degradation test. No measurement is made of subarray RF performance. A capability may be provided to add or delete failed bits found faulty by external unrelated RF tests to ascertain complete antenna performance. Correlated failures such as an entire row, column or antenna bay are considered serious failures which will not pass the screening test. Information derived from the fault identification test includes bit size (180, 90, 45, 22.5) for main array drivers or phase shifters and the location (bay/module) of each failed main array steering bit. Subarray drivers or phase shifters include bit size, location and number (1 to 3 or 1 to 6) of subarray modules affected by the particular subarray bit failure. Since the effect of each failure on performance is strongly dependent on location of the component, in order to obtain reasonable gain and null depth estimates the formulas are weighted to take appropriate aperture field distribution amplitudes into account. Relevant weights $A_i$ are listed below in Tables I, II, and III for the sum beam, elevation difference beam and azimuth difference beam. Two weights are available for each bay. The upper weight figure in each case is for subarray modules A1–3, while the lower weight is for subarray modules A4–6.

I SUM BEAM GAIN LOCATION WEIGHTS (Ai)

| H | G | F | E | D | C | B | A |
|---|---|---|---|---|---|---|---|
| | | .666 | .787 | .787 | .666 | | |
| | | .666 | .787 | .787 | .666 | | |
| | .775 | .924 | 1.093 | 1.093 | .924 | .517 | |
| | .517 | .924 | 1.093 | 1.093 | .924 | .775 | |
| .748 | 1.098 | 1.308 | 1.546 | 1.546 | 1.308 | .732 | .498 |
| .498 | .732 | 1.308 | 1.546 | 1.546 | 1.308 | 1.098 | .748 |
| .918 | 1.349 | 1.807 | 1.899 | 1.899 | 1.807 | .899 | .612 |
| .612 | .899 | 1.807 | 1.899 | 1.899 | 1.807 | 1.349 | .918 |
| .977 | 1.434 | 1.709 | 2.020 | 2.020 | 1.709 | .956 | .651 |
| .651 | .956 | 1.709 | 2.020 | 2.020 | 1.709 | 1.434 | .977 |
| .918 | 1.349 | 1.607 | 1.899 | 1.899 | 1.607 | .899 | .612 |
| .612 | .898 | 1.607 | 1.899 | 1.899 | 1.607 | 1.349 | .918 |
| .748 | 1.098 | 1.308 | 1.546 | 1.546 | 1.308 | .732 | .498 |
| .498 | .732 | 1.308 | 1.546 | 1.546 | 1.308 | 1.098 | .748 |
| | .775 | .924 | 1.093 | 1.093 | .924 | .517 | |
| | .517 | .924 | 1.093 | 1.093 | .924 | .775 | |
| | | .666 | .787 | .787 | .666 | | |
| | | .666 | .787 | .787 | .666 | | |

II ELEVATION DIFFERENCE NULL DEPTH LOCATION WEIGHTS (Ai)

| H | G | F | E | D | C | B | A |
|---|---|---|---|---|---|---|---|
| | | .208 | .234 | .234 | .208 | | |
| | | .208 | .234 | .234 | .208 | | |
| | .203 | .257 | .349 | .349 | .257 | .136 | |
| | .136 | .257 | .349 | .349 | .257 | .203 | |
| .122 | .204 | .318 | .427 | .427 | .318 | .136 | .081 |
| .081 | .136 | .318 | .427 | .427 | .318 | .204 | .122 |
| .069 | .147 | .224 | .295 | .295 | .224 | .098 | .046 |
| .046 | .098 | .224 | .295 | .295 | .224 | .147 | .069 |
| 0 | 0 | 0 | 0 | 0 | 0 | 0 | 0 |
| 0 | 0 | 0 | 0 | 0 | 0 | 0 | 0 |
| .069 | .147 | .224 | .295 | .295 | .224 | .098 | .046 |
| .046 | .098 | .224 | .295 | .295 | .224 | .147 | .069 |
| .122 | .204 | .318 | .427 | .427 | .318 | .136 | .081 |
| .081 | .136 | .318 | .427 | .427 | .318 | .204 | .122 |
| | .203 | .257 | .349 | .349 | .257 | .136 | |
| | .136 | .257 | .349 | .349 | .257 | .203 | |
| | | .208 | .234 | .234 | .208 | | |
| | | .208 | .234 | .234 | .208 | | |

III AZIMUTH DIFFERENCE NULL DEPTH LOCATION WEIGHTS (Ai)

| H | G | F | E | D | C | B | A |
|---|---|---|---|---|---|---|---|
| | | .758 | .335 | .335 | .758 | | |
| | | .758 | .335 | .335 | .758 | | |
| | 1.163 | 1.051 | .465 | .465 | 1.051 | .776 | |
| | .776 | 1.051 | .465 | .465 | 1.051 | 1.163 | |
| 1.138 | 1.648 | 1.488 | .658 | .658 | 1.488 | 1.099 | .758 |
| .758 | 1.099 | 1.488 | .658 | .658 | 1.488 | 1.648 | 1.138 |
| 1.396 | 2.024 | 1.828 | .808 | .808 | 1.828 | 1.349 | .931 |
| .931 | 1.349 | 1.828 | .808 | .808 | 1.828 | 2.024 | 1.396 |
| 1.486 | 2.152 | 1.944 | .859 | .859 | 1.944 | 1.435 | .991 |
| .991 | 1.435 | 1.944 | .859 | .859 | 1.944 | 2.152 | 1.486 |
| 1.396 | 2.024 | 1.828 | .808 | .808 | 1.828 | 1.349 | .931 |
| .931 | 1.349 | 1.828 | .808 | .808 | 1.828 | 2.024 | 1.396 |
| 1.138 | 1.638 | 1.488 | .658 | .658 | 1.488 | 1.099 | .758 |
| .758 | 1.099 | 1.488 | .658 | .658 | 1.488 | 1.648 | 1.138 |
| | 1.163 | 1.051 | .465 | .465 | 1.051 | .776 | |
| | .776 | 1.051 | .465 | .465 | 1.051 | 1.163 | |
| | | .758 | .335 | .335 | .758 | | |
| | | .758 | .335 | .335 | .758 | | |

The effect of each driver or phase shifter failure on the performance factors under consideration (sum beam gain, difference pattern null depths in elevation or azimuth) is a function of size of the failed bit and its location in the array. The effect may be written as the product of size factor Si and the location factor Ai listed in the above tables.

The size factor for each of the phase bit failures is a function of the bit size (180°, 90°, 45°, 22.5°, 49.6°, 24.8°). Size factors for main array bits are given by:

$$S_{i[Main]}=(1-\text{Cos}\ \Psi_i)$$

where:

$\Psi$ is the appropriate bit size (180°, 90°, 45°, 22.5°) for failure of a specified single bit in a phase shifter.

Size factors for subarray bits are given by the same expression divided by a factor of 3, but multiplied by the number of modules q per subarray driver:

$$S_{i[SAB]} = 1 - \text{Cos}\ \Phi_i)\ \frac{q}{3}$$

where:

$\Phi_i$=the appropriate bit size (SAB1, SAB2=24.8°, SAB3, SAB4=49.6) for failure of a specified single bit in a phase shifter q=one, assuming failure of a single subarray module.

Since it is possible to have more than one bit size failure on a single card, multiple bit failures must be taken into account. Multiple main array bit failures which are assumed to be additive are given by:

$$S_{i[Main]}=[(1-\text{Cos}\ (\Sigma\Psi_i))] \qquad \text{(Equation A)}$$

where:

$\Sigma\Psi_i$=sum of failed main array bits of the specified phase shifter, limited to 180 for worse case.

Thus, for a failure of 90° and 45° bits in the same phse shifter, let $S_{i[Main]}=(1-\text{Cos}\ 135°)$. Multiple SAB failures on a single phase shifter are also assumed to be additive and given by:

$$S_{i[SAB]} = [1 - \cos(\Sigma\Phi_i)]\ \frac{q}{3} \qquad \text{(Equation B)}$$

where:

$\Sigma\Phi_i$=Sum of failed SAB bits of the specified failed phase shifter.

Finally, multiple failures in both the main array bits and the SAB's must be considered. Therefore, the final equation for size factor S shall be given by:

$$S_i=S_{i[Main]}+S_{i[SAB]} \qquad \text{(Equation C)}$$

where:

$S_{i[Main]}$ is defined in Equation A $S_{i[SAB]}$ is defined in Equation B $S_i$ is the TOTAL failed size factor for the specified failed phase shifter.

It should be noted that the size factor equations of the failed phase bits shall apply to all performance criteria (sum beam gain, elevation and azimuth null depths). Information from this test is computed and temporarily stored until used in the additional performance measurements. The same size factors apply to all the following antenna performance criteria and are used in the appropriate computations.

Sum Beam Gain

The sum beam gain performance calculation is an indicator of gain degradation based on failed phase bits. It is the sum of all the gain degradations of the individual failed phase bits. Each individual phase bit failure degradation is computed as the product of the array location weight (A) from Table I and the size factor ($S_i$). The effect of all element failures is given by the summation:

$$F_1 = \left[\frac{1}{D_1}\left[\sum_{j=1}^{N} A_j - K\sum_{i=1}^{M} A_iS_i\right]^2\right]/F_o \qquad \text{(Equation D)}$$

where:

$F_1$=Gain degradation factor $F_0$=Undegraded sum beam gain

N=359 (number of subarray modules)

i=Location of failed bit

K=0.5—weighing factor used to model this equation to actual Near Field Probe performance. This compensates for the fact that for a particular scan/frequency only about one-half the faults result in a wrong phase state.

$A_i$=Location weight for failed bits $A_j$=Location weight for total number of bits $S_i$=Size factor of failed phase bits M=Number of failed phase bits (current faults)

$$D_i = N\sum_{j=1}^{N}(A_j)^2 = 185417.6$$

$$\sum_{j=i}^{N} = 400.982$$

$$F_o = \frac{1}{D_I}\left(\sum_{j=1}^{N} A_j\right)^2 = 0.867(-.62\ \text{dB})$$

The sum beam gain degradation in dB is given by:

$$F_5=|10\log_{10} F_i| \qquad \text{(Equation E)}$$

where:

$F_5$=Sum beam gain degradation in dB $F_i$=See Equation D

If the sum beam gain degradation ($F_5$) is greater than 1.00 dB, a fault shall be declared.

Elevation Difference Pattern Null Depth

The elevation difference pattern null depth performance is an indicator of the degradation of the elevation null depth. The null change is due to the unbalance of illumination between the upper and lower halves of the antenna resulting from element failures. Examples of antenna response curves for elevation difference null depth in an ideal case and the gain drop and null shift from an assumed degradation with current faults, are shown in FIGS. 5a and 5b. The effect of each individual phase bit failure is again computed as a product of the location weight ($A_i$) from Table II and the size factor ($S_i$). The elevation null depth is computed by taking the absolute difference between the upper and lower array degradations. It should be noted that row 5 failures (see Table II) are not used in this computation. The effect of all element failures is given by:

$$F_2 = \frac{K}{D_2}\left|\sum_{i=1}^{M_u} A_iS_i - \sum_{i=1}^{M_L} A_iS_i\right| \qquad \text{(Equation F)}$$

where:

$F_2$=Elevation null depth

N=359 (number of subarray modules)

K=0.5—weighting factor used to model this equation to actual near field probe performance.

i=Location of failed bit $M_u$=Number of failed bits in upper half of array (rows 6–9 of FIG. 1).

$M_L$=Number of failed bits in lower half of array (rows 1–4 of FIG. 1).

$A_i$=Location weight of failed bits.

$A_j$=Location weight of all bits.

$S_i$=Size factor of failed phase bits $$D_2 = \sum_{j=1}^{N/2} A_j = 35.196 \text{ (upper half only)}$$

The elevation null depth in dB is given by:

$$F_E|20 \log_{10} F_2| \qquad \text{(Equation G)}$$

where:

$F_E$=Elevation null depth in dB (limited to not greater than 45 dB)

$F_2$=See Equation F

If the elevation null depth ($F_E$) is less than 23.00 dB, a fault shall be declared.

Azimuth Difference Pattern Null Depth

The azimuth difference pattern null depth performance is an indicator of the degradation of the azimuth null depth. The null change is due to the unbalance of illumination between the left and right halves of the antenna resulting from element failures. Each individual phase bit failure is again computed as a product of the location weight ($A_i$) from Table III and the size factor ($S_i$). The azimuth null depth is computed by taking the absolute difference between the left and right array degradations. The effect of all element failures is given by:

$$F_3 = \frac{K}{D_3}\left|\sum_{i=1}^{M_{rt}} A_iS_i - \sum_{i=1}^{M_{rt}} A_iS_i\right| \qquad \text{(Equation H)}$$

where:

$F_3$=Azimuth null depth

N=359 (number of subarray modules)

K=0.5—weighting factor used to model this equation to actual Near Field Probe performance i=Location of failed bit $M_{rt}$=Number of failed bits in right half of array $M_{lt}$=Number of failed bits in left half of array $A_i$=Location weight of failed bits $A_j$=Location weight of all bits $S_i$=Size factor of failed phase bitsA $$D_3 = \sum_{j=1}^{N/2} A_j = 197.394 \text{ (left half only)}$$

The azimuth null depth in dB is given by:

$$F_A=|20 \log_{10} F_3| \qquad \text{(Equation I)}$$

where:

$F_A$=Azimuth depth in dB. (Limited to not greater than 45 dB)

$F_3$=See Equation H

If the azimuth null depth ($F_A$) is less than 23.00 dB, a fault shall be declared.

The declaring of any fault condition will result in termination of the test and the issuance of error messages. A fault bypass mode of operation may be implemented to allow testing to continue in the event of a fault being declared. In the event of fault bypass selection and the occurrence of multiple fault conditions, only the lowest fault condition will be output.

Although the present test procedure was designed for use with fielded radar systems, it may have wider application. For instance, it may be used to rapidly check the condition of phased array antennas in radars at the time of acceptance. Pass/fail criteria in such a case would be made more stringent than for fielded equipment. Acceptance thresholds that have been used were from 0.5 dB for gain degradation and 30 dB for null depths. While only a single embodiment has been illustrated and described, it is apparent that other variations may be made in the particular configuration and procedure without departing from the scope of the invention as set forth in the appended claims.

What is claimed is:

1. Apparatus for evaluating performance characteristics of phased array antennas comprising:

a planar antenna array having a plurality of bays arranged in a rectangular matrix, each bay including a plurality of subarray modules, each module having a plurality of pairs of dipole radiators and a plurality of diode phase shifters applying phase shifts of predetermined angular sizes to respective pairs of dipoles, said subarray modules being assigned a predetermined weight factor dependent upon location in said matrix for a particular antenna performance characteristic;

a beam steering computer scanning said phase shifters and dipoles in a predetermined sequence, said beam steering computer including a plurality of drivers applying bias voltages to said phase shifters in accordance with said angular sizes and sequence; and test means for extracting data related to current failures for said plurality of diode phase shifters and for measuring said antenna performance characteristics including field distribution amplitudes for sum beam gain and elevation and azimuth difference pattern null depths, said beam steering computer processing said data from relationships including factors representing number and size and weighted location of said failed phase shifters for each of said performance characteristics, said test means indicating an antenna fault upon exceeding a performance degradation of a predetermined threshold for each characteristic.

2. The apparatus of claim 1 wherein said dipole radiators and diode phase shifters include a main array providing large beam scanning angles and a subarray providing a smaller elevation scanning angle, said main array having corresponding larger angular size diode phase shifters and said subarray having smaller angular size diode phase shifters.

3. The apparatus of claim 2 wherein said main array dipoles are controlled by four-bit phase shifters applying phase bit angles of 22.5°, 45°, 90°, and 180°, and said subarray dipoles are controlled by phase shifters applying phase bit angles of 24.8° and 49.6°.

4. The apparatus of claim 3 wherein size factors for each phase bit failure are a function of bit size, size factors for main array bits being given by:

$$S_{i[Main]}=(1-\text{Cos}\ \Psi_i)$$

where $\Psi$ is the appropriate bit size (180°, 90°, 45°, 22.5°) for failure of a specificed single bit in a phase shifter; and size factors for subarray bits being given by:

$$S_{i(SAB)} = (1 - \text{Cos}\ \Phi_i)\frac{q}{3} \text{ where}$$

$\Phi_i$ is the appropriate bit size (24.8°, 49.6°) for failure of a specified single bit in a phase shifter, and q is the number of modules per subarray driver.

5. The apparatus of claim 4 wherein performance degradation of sum beam gain from failed phase bits is given by:

$$F_i = \left[\frac{1}{D_i}\left[\sum_{j=1}^{N} A_j - K\sum_{i=1}^{M} A_iS_i\right]^2\right]/F_o$$

where $F_1$=Gain degradation factor
$F_0$=Undegraded sum beam gain
N=Number of subarray modules
i=Location of failed bit
K=0.5, weighting factor
$A_i$=Location weight for failed bits
$A_j$=Location weight of total number of bits
$S_i$=Size factor of failed main and subarray phase bits
M=Number of failed bits (current faults)

$$D_1 = N\sum_{j=1}^{N}(A_j)^2 = 185417.6$$

$$\sum_{j=1}^{N} A_j = 400.982$$

$$F_o = \frac{1}{D_1}\left(\sum_{j=1}^{N} A_j\right)^2 = .867, \text{ and}$$

$F_S$ (Sum beam gain degradation in dB)=$|10\log_{10} F_1|$, wherein if $F_S$ is greater than a predetermined threshold a fault is declared.

6. The apparatus of claim 5 wherein performance degradation of elevation null depth from failed phase bits is indicated by the difference in elevation pattern null depth degradation between the upper and lower halves of the antenna array and is given by:

$$F_2 = \frac{K}{D}\left|\sum_{i=1}^{M_u} A_iS_i - \sum_{i=1}^{M_L} A_iS_i\right|$$

where:

$F_2$=Elevation null depth
N=Number of subarray modules
K=0.5, weighting factor
i=Location of failed bit
$M_U$=Number of failed bits in upper half of array
$M_L$=Number of failed bits in lower half of array
$A_i$=Location weight of failed bits
$A_j$=Location weight of all bits
$S_i$=Size factor of failed main and subarray phase bits $$D_2 = \sum_{j=1}^{N/2} A_j = 35.196 \text{ (upper half only)}$$

F (elevation null depth in dB)=$|20\log_{10} F_2|$ wherein if $F_E$ is less than a predetermined threshold 2 fault is declared.

7. The apparatus of claim 6 wherein performance degradation of azimuth null depth from failed phase bits is indicted by the difference in azimuth pattern null depth degradation between the left and right halves of the antenna array and is given by:

$$F_3 = \frac{K}{D_3}\left|\sum_{i=1}^{M_{rt}} A_iS_i - \sum_{i=1}^{M_{1t}} A_iS_i\right|.$$

where $F_3$=Azimuth null depth
N=Number of subarray modules
K=0.5, weighting factor
i=Location of failed bit
$M_{rt}$=Number of failed bits in right half of array
$M_{lt}$=Number of failed bits in left half of array
$A_i$=Location weight of failed bits
$A_j$=Location weight of all bits
$S_i$=Size factor of failed main and subarray phase bits $$D_3 = \sum_{j=1}^{N/2} = 197.394 \text{ (left half only)}$$

$F_A$(azimuth null depth in dB)=$|20\log_{10} F_3|$ wherein if $F_A$ is less than 23 a predetermined threshold a fault is declared.

* * * * *